US005111643A

United States Patent [19]

Hobock

[11] Patent Number: 5,111,643

[45] Date of Patent: May 12, 1992

[54] APPARATUS AND FASTENER SUPPLY STRIP FOR ATTACHING RECLOSABLE FASTENER TO PLASTIC BAGS

[75] Inventor: Edgar G. Hobock, Fresno, Calif.

[73] Assignee: Sun-Maid Growers of California, Kingsburg, Calif.

[21] Appl. No.: 749,062

[22] Filed: Aug. 23, 1991

[51] Int. Cl.[5] ..... B65B 9/20; B31B 1/90

[52] U.S. Cl. ..... 53/551; 53/139.2; 53/552

[58] Field of Search ..... 53/133.4, 139.2, 412, 53/451, 551, 552; 493/214

[56] References Cited

U.S. PATENT DOCUMENTS 4,355,494 10/1982 Tilman ..... 493/214
4,617,683 10/1986 Christoff .
4,709,533 12/1987 Ausnit .
4,840,012 6/1989 Boeckmann .
4,874,257 10/1989 Inagaki .
5,046,300 9/1991 Custer et al. ..... 53/412

*Primary Examiner*—William E. Terrell

*Attorney, Agent, or Firm*—Townsend and Townsend

[57] ABSTRACT

A fastener strip, with interlocking profiles of resilient material for purposes of enabling one to reclose a plastic bag after its initial opening, is secured to the bag as the bag is being formed over a cylindrical forming tube. To accomplish this, a continuous carrier strip to which the fastener strip material is mounted is passed into the interior of the forming tube to a port in the tube wall, the strip thereby passing to the outer surface of the tube where it travels part way around the tube circumference, reentering the tube interior through a second port. Between the ports, the carrier strip exposes the fastener strip mounted to it to the web from which the bag is being formed, and the fastener strip is heat fused to the web. A specially constructed combination strip which combines the carrier strip and the fastener strip material allows the two to readily separate once the fastener strip material is bonded to the web. This arrangement permits the fastener strip material to be applied to the bag web after the two interlocking halves of the fastener strip material have been joined.

7 Claims, 3 Drawing Sheets

APPARATUS AND FASTENER SUPPLY STRIP FOR ATTACHING RECLOSABLE FASTENER TO PLASTIC BAGS

This invention lies in the field of plastic and foil bag manufacture, and particularly the manufacture of reclosable bags, with a focus on methods of bonding the reclosable fastener strip to the bag.

BACKGROUND OF THE INVENTION

There are various types of bags on the market and in the technical literature with reclosable fastener strips. These bags are made from a variety of materials and assume a variety of forms, reflecting such factors as whether or not the bags are supplied to consumers with a product inside, what type of material they are designed to hold, and the direction and orientation by which they are to be opened. The materials include cellophane, plastics such as polypropylene and mylar, and foils such as tin and aluminum foils, including those with a laminated plastic or cellophane backing. The fastener strips are of mated resilient material permitting opening and closing by hand to form a mechanical closure which can be made air-tight and water-tight. A typical bag generally has an axial direction defined during its manufacture as perpendicular to the transverse end seals which close off the cylindrical plastic web material from which the bag is formed. Manufacturing procedures vary from those in which the reclosable fastener strip is placed longitudinally (parallel to the bag axis) to those in which the strip is placed in a direction transverse to the bag axis.

The reclosable bags addressed by this invention are those in which the reclosable fastener strip is transverse to the bag axis. One example of such a bag is one which when supplied to the consumer has top and bottom ends fused together with a product hermetically sealed inside, the reclosable fastener strip forming a auxiliary closure toward the top end for repeated closing and reopening after the fused closure has been broken, each time producing an air-tight seal. This combination of closures protects the user against tampering with the bag and contents with between bagging plant and point of purchase, while affording the user the option of tightly reclosing the bag after removing only a portion of the bag's contents after the initial opening. Information relevant to the construction and manufacture of such bags is found in Christoff, P.B., U.S. Pat. No. 4,617,683, issued Oct. 14, 1986, and other patents cited therein.

A method typically used in the industry for forming plastic bags is that disclosed in the Christoff patent. A continuous sheet or web of the plastic material is drawn over and wrapped around a forming tube by drawing the two edges of the sheet together to form a seam or fin parallel to the tube axis, the seam being fused while still on the tube by vertical heat sealing bars positioned along on the tube exterior. Product is fed to the tube interior through a hopper at the top, above the level at which the plastic web first contacts the tube. At a point below the lower extremity of the forming tube, the bag material, now in cylindrical form, is sealed off in the transverse direction by horizontal heat sealing bars, thereby forming seals commonly referred to as jaw seals, and severed to form separated bags, each sealed shut at both top and bottom ends with a measured quantity of product inside. Advancement of the web may be performed in various ways. One example is by the jaw seal bars which move downward in increments while still gripping the jaw seals. Another example is by drive belts on the side of the forming tube, gripping the material by friction or by vacuum. In either case, the downward movement coordinated with the incremental feed of product to the hopper and the activation of the fin seal bars.

Attachment of the reclosable fastener strip on the web material is performed in the Christoff disclosure at a point in the web path upstream of the first contact of the web with the forming tube. A single continuous strip of extruded plastic material is drawn across the width of the web and, once in position, cut to the length of the web and bonded to it. The web is then wrapped around the forming tube, its edges joined and fused to form the fin seal, and the web in cylindrical form is then flattened to form the jaw seals as described above. During this process, the strip of extruded plastic material is folded over itself, its two facing surfaces having been contoured to mate in a manner permitting them to become engaged and disengaged by manual pressure to form the reclosable closure.

One concern raised by such a process is the need for precise alignment of the two halves of the folded fastener strip material when it reaches the jaw seal bars. Deviations from proper alignment will preclude an effective mating of the two halves of the strip material, rendering the strip useless. Such deviations will result from skewing, stretching or other distortion of the web at any point in the travel path of the web both on its approach to and its passage over the forming tube. Since there is a considerable distance between the points in the web path where the fastener strip is bonded to the web and where the web is closed to form the jaw seals, any deviations or readjustments occurring along this portion of the path will cause such a misalignment.

Another concern is the complicated mechanism and succession of motions involved in drawing the fastener strip material across the spread web. A carrier first travels the full width of the web to position the strip material, then travels the same distance in the opposite direction to regain its original position and prepare for a new length of the strip material. These are time-consuming steps in an otherwise continuously repeated process.

A still further concern is the requirement for fastener strip material which must mate and interlock with itself when folded over. The contacting faces being of identical contour are capable of interlocking only when offset. Thus, even when the two halves are perfectly aligned, the bag will never be perfectly flat when closed and the reclosable closure never perfectly aligned.

SUMMARY OF THE INVENTION

An apparatus and method for reclosable bag manufacture have now been developed which overcome these problems and others encountered by the existing technology.

Web material in accordance with this invention is drawn over a forming tube and the edges drawn together to form a fin seal, in a manner similar to that disclosed by Christoff above. The fastener strip however is provided in pre-mated form, the two separable halves already joined prior to bonding to the web. Furthermore, initial contact and bonding between the fastener strip and the web occur on the forming tube after the fin seam has been fused, rather than before. The result is a reclosable closure in which both sides are joinable without offset or other distortion of the bag, and in which the risk of fastener strip misalignment from movement irregularities of the web is considerably less than that encountered in previous methods of this type.

The invention further resides in a combination carrier strip and severable fastener strip. The fastener strip is mounted to the carrier strip and remains so until the two are separated by a transverse force. The fastener strip, while still mounted to the carrier strip, is segmented into appropriate lengths. The carrier strip thus serves as a vehicle for drawing the fastener strip, thus segmented, across the web, and separation of the fastener strip in segments from the carrier strip is readily achieved by simple advancement of the web after the fastener strip is bonded to it. In addition, the motion of the carrier strip is limited to a single direction, which simplifies the entire mechanism and renders it more amenable to coordination with the jaw sealing action.

In further preferred embodiments of the invention, the advancement of the carrier strip and the advancement of the web occur simultaneously. The fastener strip segment and the location on the web to which the segment will be attached simultaneously approach the location on the forming tube where the bonding of one to the other will take place. This reduces the number of stages in the sequence of the process, permitting a larger output of units per unit time, and simplifying the automation.

Other features and advantages of the invention will become apparent from the description which follows.

DETAILED DESCRIPTION OF THE INVENTION PREFERRED EMBODIMENTS

Figure 1:
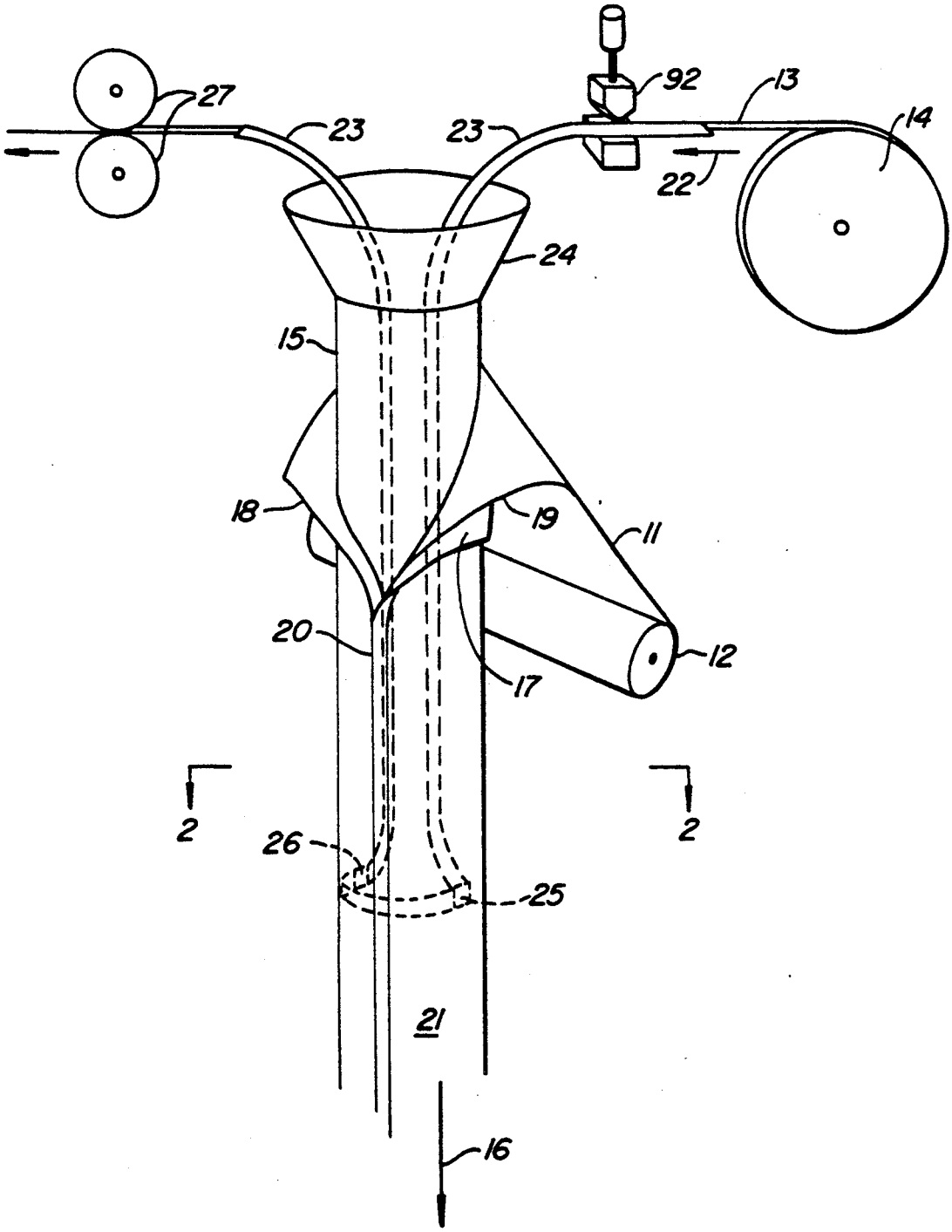
FIG. 1 is a perspective view of apparatus illustrative of the present invention, including portions of the forming tube, the conduit, and drive mechanism directing the travel of the fastener strip material, and the web material and fastener strip material from which a finished bag is formed.

An illustration of the flow paths of the web and the fastener strip material in accordance with this invention is shown in FIG. 1.

Plastic sheet web material 11 is drawn from a roll 12 or other continuous or large-supply source, while mated fastener strip material 13 is similarly drawn from a roll 14 or other continuous or large-supply source. The web material 11 is pulled toward and down the length of the forming tube 15 by jaw seal bars (shown in a subsequent figure and discussed below) located below the lower end of the forming tube, which grasp the web material and pull it down in the direction shown by the arrow 16. As it is being pulled down, the web material is wrapped around the forming tube by a forming shoulder 17 which guides the two edges 18, 19 of the web toward each other, thereby forming a fin seal 20 and converting the web into a continuous cylinder 21 of web material.

A carrier strip 13 containing the material used to form the reclosable fastener strip is pulled in the direction indicated by the arrow 22 along a guide rail or tube 23 which passes through the hopper 24 of the forming tube 15 into the interior of the forming tube, down the tube interior to a location below the forming shoulder 17, out to the exterior of the tube through an exit port 25 in the tube wall, approximately halfway around the outside of the tube to a reentry port 26 where it reenters the tube interior, back up the tube and out through the hopper 24. This movement of the carrier strip 13 is driven by drive rollers 27, pulling the strip along its track. The fastener material on the carrier strip 13 thus contacts the web material 11 only along a line along the circumference of the forming tube 15 between the exit port 25 and the reentry port 26. While only one direction of the carrier strip is indicated in the drawing, the choice of direction is not critical, and the components may be likewise be arranged for carrier strip travel in the opposite direction.

Figure 2:
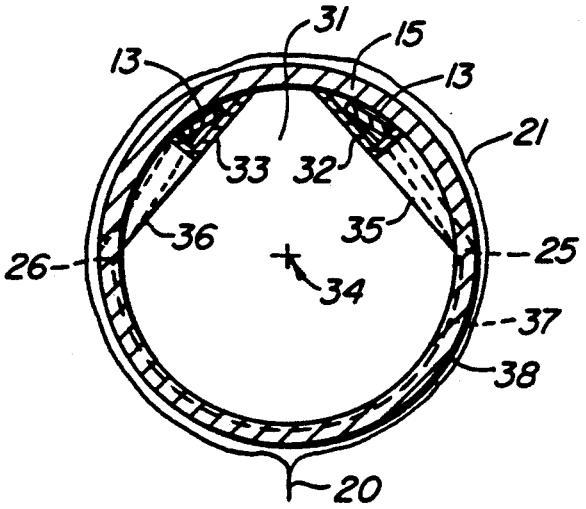
FIG. 2 is a transverse cross section of the forming tube taken along the line 2—2 of FIG. 1.

FIG. 2 is a cross section of the forming tube taken along the line 2—2 in FIG. 1. Shown in this FIG. are the forming tube 15, its hollow interior 31, the continuous cylinder 21 of web material surrounding the forming tube, the fin seam 20 of the web material cylinder, and the carrier strip 13. Due to the shape and arrangement of the forming shoulder 17 (FIG. 1), the web material cylinder 21 is loosely wrapped around the forming tube 15 so that the cylinder will slide easily when pulled.

On the inside wall of the forming tube 15 are conduits 32, 33 which are continuations of the guide rail or tube 23 shown in FIG. 1 and which guide the passage of the carrier strip 13 which bears the fastener strip material. In this embodiment, downward travel of the carrier strip (i.e., into the plane of the FIG.) toward the exit port 25 occurs in the right conduit 32 and upward travel from the reentry port 26 occurs in the left conduit 33. For most of their lengths, these conduits are parallel to the axis 34 of the forming tube. At their lowermost ends, these conduits have curved sections 35, 36 leading to the exit port 25 and reentry port 26, respectively.

A groove 37 in the outer surface 38 of the forming tube connects the exit and reentry ports. It is only in this groove 37 that the fastener material carrier strip 13 and the web material cylinder 21 come into contact. The groove 37 also keeps the carrier strip horizontal at the appropriate height on the forming tube as the web material passes over it. As will become evident from the discussion below of FIG. 4, the groove 37 by virtue of its inner contour also facilitates the separation of the fastener strip material from the carrier strip 13 once the fastener strip portion is bonded to the web cylinder.

Figure 3:
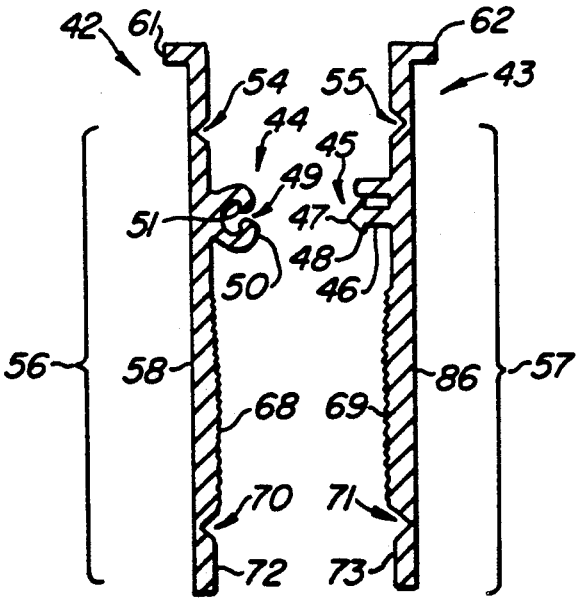
FIG. 3 is a cross section of two separated halves of a carrier strip to each half of which is mounted fastener strip material for use with the apparatus of FIG. 1, with web material and fastener strip material also shown.

FIG. 3 illustrates a carrier strip construction with integrated fastener strip material for use with the forming tube 15 construction and conduit arrangement shown in the preceding FIGS. The carrier strip consists of two halves 42, 43 of extruded resilient, generally elastomeric, material. Sections of the facing surfaces of the two halves are contoured to contain fixtures 44, 45 of complementary profiles which engage each other and interlock upon manual pressure and are likewise separable by manual force.

A wide variety of interlocking profiles are known among those skilled in the art and are suitable for use in this invention. Such profiles will generally consist of one or more male members on one half and one or more female members complementary to the male members on the other, or a combination of male and female members on one with an opposing combination on the other in a complementary arrangement. In the embodiment shown in FIG. 3, only one male and one female member are shown for purposes of simplicity. The male member is a protruding rib 46 with an expanded head 47 forming flanges 48 on both sides, whereas the female member contains a trough 49 to receive the rib 46 with inwardly turned edges 50 which form shoulders 51 internal to the trough to engage the flanges 48. An important feature of the structure of these members is their complementary profile and directly opposing location on the two halves 42, 43 of the carrier strip. As a result of this feature, no offset of the halves is required for the male and female members to join.

Figure 4:
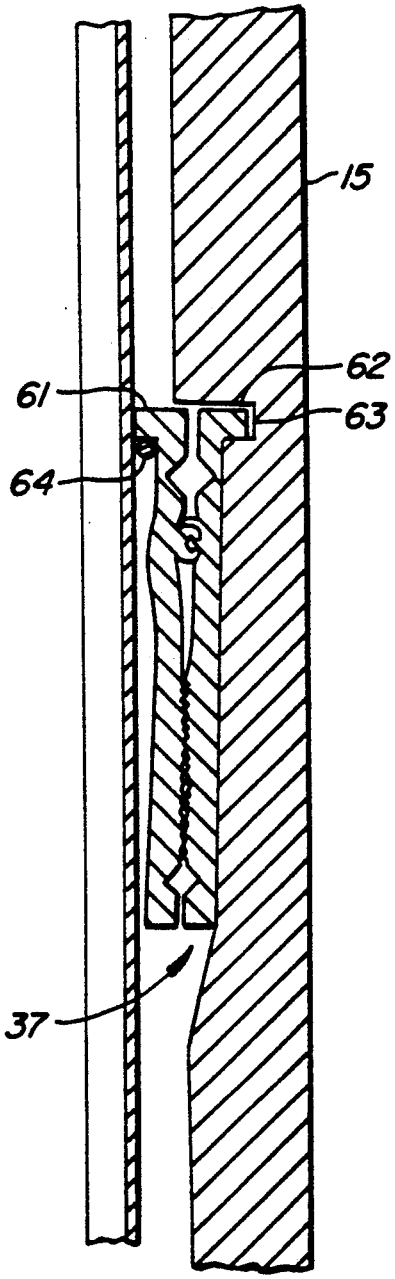
FIG. 4 is a longitudinal cross section of a portion of the forming tube of FIG. 1.

The two halves 42, 43 are extrudates, and the female and male members 44, 45 extend longitudinally along the carrier strip with the constant cross-sectional profiles shown in FIG. 3. The two halves 42, 43 are shown separated in FIG. 3 for ease of illustration of the profiles. During operation of the apparatus, the two halves are joined as shown in FIG. 4 and move as a unit.

To one side of the male and female members on each half of the carrier strip (i.e., above the members, according to the view shown in the drawing) is a pair of opposing notches which serve as score lines 54, 55. These score lines mark the line of separation between the portion of the carrier strip which forms the two halves of the fastener strip 56, 57 on the finished bag (below the lines in this view) and the portion (above the lines) which remains in the groove 37 (FIG. 2) and travels the full distance of the guide tube 23 to the drive rolls 27 (FIG. 1).

As explained further below, once the carrier strip (42, 43 joined) and the web material cylinder 21 (FIGS. 1 and 2) have advanced to the point where the two are properly aligned for joining together, movement of the two will be temporarily suspended and a fusing unit will approach the cylinder from the outside at the location of the underlying groove 37 of the forming tube. The fusing unit (not shown in this drawing) will bond the web material cylinder to the exposed outer surface 58 of one half of the fastener strip below the score line 54 along the length occupying the groove 37. The downward movement of the web material cylinder 21 will then be resumed, and the moving cylinder will draw with it the fastener strip portion 56 of the carrier strip, severing the two portions at the score line 54. Prior to reaching this point, the fastener strip portion 56 below the score line will have been cut transversely into lengths equal to the length of the groove 37, the cuts not extending into the portion above the score line. The fastener strip portion 56 is thus separated into discrete lengths individually fused at measured distances along the web material cylinder as the cylinder is advanced. Since the two halves 42, 43 of the carrier strip are joined, the opposing half 43, with similarly spaced cuts crossing the fastener strip portion but not extending above the score line 55, is similarly severed at the score line, causing the two halves 56, 57 of the fastener strip thus severed at the score lines and separated at the transverse cuts to remain joined and travel downward with the web cylinder.

The result is a fusing of the fastener strip on one side only to the interior surface of the web cylinder along a length extending approximately half the circumference of the cylinder. The remaining side of the fastener strip is fused to the remainder of the cylinder circumference at a point further downstream in the flow path of the cylinder, as will be explained below.

Additional features of the two halves 42, 43 of the carrier strip are a pair of outwardly extending flanges 61, 62, one on each of the two halves and located on the side of the score lines 54, 55 opposite the fastener strip portions 56, 57. These flanges facilitate the severing of the two halves of the carrier strip at the score lines 42, 43. As seen in FIG. 4, the groove 37 on the outer surface of the forming tube 15 contains a trough 63 at its upper end to receive the flange 62 of the inner half 43 of the carrier strip. Adjacent to the groove and rigidly affixed to the outer surface of the forming tube is a length of retaining wire or band 64, which follows the contour of the groove and engages the flange 61 of the outer half 42 of the carrier strip. The shoulder 65 of the trough and the retaining band hold up the upper portions of the two halves 42, 43 of the carrier strip as the lower portions 56, 57 are being drawn downward, thereby facilitating the separation at the score lines 54, 55.

As an alternative to the flanges 61, 62, the upper edges of the two halves 42, 43 above the score lines 54, 55 may be bonded together, lending those upper edges an increased mass which will facilitate the separation at the score lines 54, 55. Another alternative is the use of a low-rise convex ridge on the exterior of one or both of the halves, with a corresponding concave groove in place of the trough 63.

In the embodiment of the invention shown in these FIGS., the bag is being formed upside down. When on the forming tube, the fastener strip halves 42, 43 are attached immediately above the location on the web cylinder where a transverse cut which will separate the cylinder into individual bags (as discussed below) will be made. When the bag is subsequently inverted to an upright position, the fastener strip is located at the top. The view of the fastener strip presented in FIG. 3 is thus upside down, the lowermost ends 66, 67 of the two halves as they appear in the FIG. instead residing above the mating members 44, 45, toward the bag opening.

In this embodiment, the fastener strip portions 56, 57 contain, in addition to the reclosable mating members 44, 45, two opposing surfaces 68, 69, which will be fused together to form the initial non-reclosable fused seal at one end of the bag. These surfaces terminate in notches 70, 71 which separate them from shorter, slightly recessed surfaces 72, 73. Due to their recessed configuration, these surfaces will not be fused together since they will not contact each other when the adjacent surfaces 68, 69 are brought into contact. In the finished bag, these non-fused surfaces 72, 73 can be grabbed manually, and they and the notches 70, 71 will enable one to easily spread apart and grip the two sides of the bag for easy opening to break the seal between the fused surfaces 68, 69. The notches 70, 71 and gripping extensions 72, 73 are an option, and can be eliminated entirely.

Figure 5:
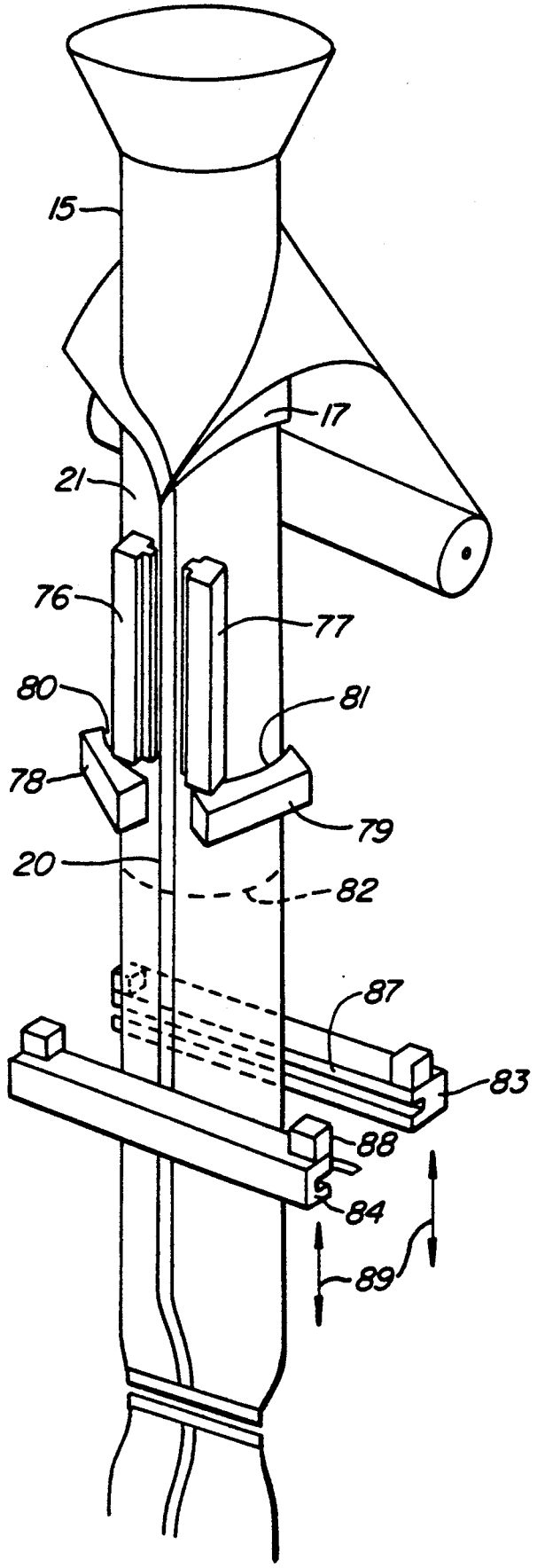
FIG. 5 is a further perspective view of the apparatus of FIG. 1, the sealing bars and cutting tool for forming and separating the web material into individual bags.

The various seals or bonds involved in the formation of the bags are made by conventional means well known among those skilled in the art. The most notable methods are those involving the application of heat and pressure to fuse two plastic surfaces together. The arrangement and operation of heat sealing bars serving the purposes of the present invention are illustrated in FIG. 5.

The fin seal 20 is bonded by vertical heat sealing bars 76, 77 located above the exit and reentry ports 25, 26 in the forming tube (FIG. 1) and below the forming shoulders 17. The vertical sealing bars are drawn together at designated stages in the continuous operation of the apparatus, trapping the two longitudinal edges of the web between them and sealing the edges together.

Curved horizontal heat sealing bars 78, 79 are positioned level with the exit and reentry ports 25, 26. These curved horizontal bars 78, 79 have inner surfaces 80, 81 facing the web cylinder 21, each surface following the curvature of the outer surface of the forming tube 15. Together the two horizontal sealing bars 78, 79 extend approximately the full length of the groove 37 (FIGS. 2 and 4) along which the fastener strip material travels as it is drawn into position by the carrier strip 13. In operation, these two horizontal sealing bars are drawn inward radially relative to the axis of the forming tube to contact the web cylinder 21 and press it against the fastener strip. Unlike the fin seal formation, these bars heat the plastic parts from one side only (the web cylinder side), but sufficient heat penetrates the web cylinder to the fastener strip surface to fuse the surfaces together. As the bars are drawn inward, the two curved surfaces 80, 81 join to form a continuous curved surface, applying heat along the full length of the fastener strip.

As an alternative to the use of the curved horizontal heat sealing bars 78, 79 at a location on the forming tube which is level with the exit and reentry ports 25, 26, the web may be tacked to the carrier strip at the same location. Conventional tacking devices known among those skilled in the art may be used, and the tacking will be temporary. Final sealing will then be done when the bags are severed and the ends sealed, as described below.

The forming tube 15 terminates at a level 82 below the curved horizontal heat sealing bars 78, 79. Below this level are located straight horizontal sealing jaws 83, 84 which are drawn together to flatten the web cylinder and seal it closed, again by pressure and heat. A cutting tool 85 positioned inside one of the jaws at approximately mid-height severs the cylinder into individual bags, leaving sealed ends on either side of the cut.

In addition to closing and severing the bag from the cylinder, the horizontal sealing jaws 83, 84 also seal the unbonded side 86 of the fastener strip (see FIG. 3) to the opposite side of the web cylinder. This is achieved by coordinating the motion of the web cylinder and the sealing jaws such that the sealing jaws are activated when the fastener strip is positioned between the jaws above the mid-height level. Thus, when the two sealing jaws 83, 84 are drawn together, the upper halves 87, 88 of the jaws (i.e., the sealing surfaces above the cutting tool) are level with the opposing contact surfaces 70, 71 on the insides of the two halves of the fastener strip but do not extend as high as the level of the reclosable mating fixtures 44, 45.

As a result, the seal formed below the cutting tool 85 is achieved by fusing together the web material of the cylinder itself, while the seal formed above the cutting tool is achieved by fusing together two pairs of opposing surfaces ——the unbonded side 86 of the fastener strip to the inner surface of the cylinder web, and the opposing contact surfaces 68, 69 on the two halves 56, 57 of the fastener strip to each other. Fused jaw seals fully closing the web cylinder on each side of the cut are thus formed, these seals being non-reclosable when opened, with an auxiliary reclosable jaw seal adjacent to (i.e., underneath, when the bag is inverted) one of the fused jaw seals.

The horizontal sealing bars 83, 84 may serve a still further function, that of drawing the web cylinder 21 down the forming tube. To do this, the bars when closed move down in the direction of the arrow 89 by a distance corresponding to one bag length. This is done before, during or after heat is applied by the bars to fuse the bag closed, and before, during or after the bag is severed by the cutting tool 85. When the fusing, cutting and advancing functions are all completed, the bars are opened and return to the upward position to repeat these functions at a location one bag length further up the cylinder. Alternatively, the web cylinder may be drawn down by drive belts (not shown) on either side of the forming tube, gripping the web by either friction or by vacuum.

All sealing bars utilized in the invention may be of convention construction and may operate under know heat sealing principles.

In further preferred embodiments of the invention, the ends of the reclosable mating fixtures 44, 45 of the fastener strip segment in each bag are fused together to ensure the alignment of the fixtures with each other and thereby facilitate the reclosing of the bag. This is preferably done while the fastener strip is still mounted on the carrier strip upstream of its entry through the hopper 24 into the forming tube 15. This may be achieved in any of a variety of ways readily apparent to those skilled in the art. One example is through the use of a sealing or tacking head 92 (FIG. 1) positioned on the inlet end of the guide rail or tube 23 which guides the moving carrier strip. The location of the head 92 will be such that it will be aligned with a transverse cut on the fastener strip at the same time that an incremental length between such transverse cuts is positioned between the exit and reentry ports 25, 26 on the forming tube. The size of the head will be such that it fuses a short length on either side of the transverse cut positioned underneath it.

In addition, it is preferable to fuse both ends of the mating fixtures 44, 45 to the inner surface and corners of the bag itself, to eliminate possible leaks at the two lateral edges of the finished bag. This as well may be achieved in ways well known or readily apparent to those skilled in the art. One example is shown in FIG. 5. In this example, the sealing is accomplished by four sealing blocks 94, 95, 96, 97 formed as extensions of the horizontal sealing jaws 83, 84, and laterally spaced by a distance equal to the flattened width of the web cylinder 21. When the fastener strip is in the position described above for its final sealing to the bag interior (and to itself), the four sealing blocks will extend upwards tot eh level of the mating fixtures and will be aligned with its ends. The blocks press against each other with the ends of the mating strip in between, the blocks emitting heat in the same manner as the remaining surfaces of the sealing jaws, fusing the surfaces in back of the mating fixtures to the inner bag wall and closing any gaps occurring at the ends.

To summarize the operation of the entire apparatus, the components whose motions are coordinated include:

the drive rolls 27;

the vertical fin-sealing bars 76, 77, which move tangentially with respect to the forming tube;

the curved horizontal fastener strip sealing bars 78, 79, which move radially toward the axis of the forming tube;

the horizontal jaw seal bars 83, 84, which move horizontally toward each other and transverse to the axis of the forming tube;

the cutting tool 85, which moves parallel to the jaw seal bars; and the tacking head 92, which moves toward and away from the guide rail 23 along which the carrier strip with the fastener material is drawn.

The components are preferably controlled by a central automated control unit. In a preferable mode of operation, the drive rolls 27 and the jaw seal bars 83, 84 will operate simultaneously to draw the precut length of fastener strip material, still mounted to the carrier strip 23, into position in the groove 37 between the exit and reentry ports 25, 26, while the web cylinder 21 is advanced downward an incremental length corresponding to the length of one bag, so that the position on the web cylinder where the end of the bag will ultimately be formed is placed adjacent to the groove. The drive rolls will then stop and the jaw seals will separate and begin their travel upward to return to their starting position. While both the web cylinder and carrier strip are stationary, the vertical fin-sealing bars 76, 77 will close and apply heat to form the fin seal, the curved horizontal fastener strip sealing bars 78, 79 will move inward to press against the forming tube and apply heat to secure one side of the fastener strip to the web material, and the tacking head 92 will descend to fuse short sections of the mating members 44, 45 on the carrier strip on either side of a transverse cut.

The apparatus may also be used to place product inside the bag as it is being formed. This is achieved by feeding incremental amounts of the product into the hopper 24, from which these amounts will descend through the interior of the forming tube, out through its open lower end 82 and into the cylindrical web material above the jaw seal last formed. The timing of the product feed will be coordinated with the timing of the other moving components listed above in an appropriate manner readily apparent to one skilled in the art.

The foregoing is offered primarily for purposes of illustration. Variations and alternatives, still embodying the basic concepts and spirit of the invention, will be readily apparent tot hose skilled in the art.

What is claimed is:

1. Apparatus for the manufacture of a reclosable bag, said apparatus comprising:

a hollow cylindrical forming tube having a longitudinal axis;

first conveying means for drawing an elongate sheet of web material from a continuous supply thereof around said forming tube while joining together the longitudinal edges of said elongate sheet to form a continuous cylinder of said web material;

second conveying means for drawing a continuous carrier strip into the interior of said forming tube, then through a first port in the wall of said forming tube to pass between said forming tube and said continuous cylinder of web material, and then through a second port in said wall of said forming tube displaced from said first port along the circumference of said forming tube, to return to the interior of said forming tube, said continuous carrier strip having affixed thereto mated fastener strip material;

first bonding means for bonding the portion of said mated fastener strip material between said first and second ports to said continuous cylinder of web material and for separating said mated fastener strip material thus bonded from said carrier strip; and second bonding means for converting said continuous cylinder of web material with said mated fastener material thus bonded thereto into bags sealed at both ends, as aid mated fastener strip material thereby forming a reclosable closure on each such bag.

2. Apparatus in accordance with claim 1 in which said first and second conveying means are coordinated such that a selected location along the axis of said continuous cylinder of web material to which said mated fastener material is to be bonded, and mated fastener material to be bonded at said selected location, are drawn simultaneously into position between said first and second ports.

3. Apparatus in accordance with claim 1 in which said first bonding means bonds one side of said mated fastener strip material to said continuous cylinder of web material along approximately one half the circumference thereof, and said second bonding means bonds the other side of said mated fastener strip material to the remainder of said circumference, thereby forming a closure.

4. Apparatus in accordance with claim 1 in which said mated fastener strip material is separable from said carrier strip by pulling the two apart, and said apparatus is arranged and constructed such that said first conveying means thus separates said mated fastener strip material from said carrier strip at the location of said first and second ports by pulling said continuous cylinder of web material with said mated fastener strip bonded thereto axially along said forming tube.

5. Apparatus in accordance with claim 1 further comprising a retaining groove along the external surface of said forming tube and extending from said first to said second port, said retaining groove contoured to guide the travel of said carrier strip therethrough with means for holding said carrier strip therein when a force transverse to said groove is exerted on said mated fastener strip material.

6. Apparatus in accordance with claim 1 in which:

said mated fastener strip material is comprised of two separable halves; and said first bonding means defines a length of said mated fastener strip material bonded to said web material and separated from said continuous carrier strip; and said apparatus further comprises third bonding means for permanently bonding together said separable halves at both ends of each said length.

7. Apparatus in accordance with claim 1 further comprising:

third bonding means for bonding together said separable halves at both ends of each said length, said third bonding means positioned upstream of said first port in terms of the direction of said second conveying means.

* * * * *